US005242319A

United States Patent [19]

Ju

[11] Patent Number: 5,242,319

[45] Date of Patent: Sep. 7, 1993

[54] ELECTRICAL CONNECTORS

[76] Inventor: Ted Ju, 18, Lane 30, Syh Wei Rd., Wu Gu Hsiang, Taipei Hsien, Taiwan

[21] Appl. No.: 986,547

[22] Filed: Dec. 7, 1992

[51] Int. Cl.[5] ..... H01R 13/514

[52] U.S. Cl. ..... 439/752; 439/654; 439/655

[58] Field of Search ..... 439/638-655, 439/731, 752, 751, 873, 695, 696, 701

[56] References Cited

U.S. PATENT DOCUMENTS

| | | | |
|---|---|---|---|
| 2,649,522 | 8/1953 | Marcus | 439/651 |
| 3,945,705 | 3/1976 | Siem et al. | 439/752 |
| 4,148,545 | 4/1979 | Kies | 439/655 |
| 4,386,820 | 6/1983 | Dola et al. | 439/651 |
| 4,781,625 | 11/1988 | Yang | 439/654 |
| 5,190,481 | 3/1993 | Ju | 439/752 |

FOREIGN PATENT DOCUMENTS

| | | | |
|---|---|---|---|
| 0652241 | 10/1985 | Switzerland | 439/701 |

*Primary Examiner*—David L. Pirlot

*Attorney, Agent, or Firm*—Wenderoth, Lind & Ponack

[57] ABSTRACT

An electrical connector is disclosed including two face-matched plastic mounting members covered with an outer shell to hold a row of intermediate terminals and pairs of lateral terminals, wherein the plastic mounting members have each big and small transverse recesses alternatively arranged on a respective inside face; each intermediate terminal has a flat, rectangular central portion respectively fitted into either small transverse recess and two opposite free ends extended out of the mounting members through respective through holes; each lateral terminal of the pairs of lateral terminal has a flat, parallelogramic central portion respectively fitted into either big transverse recess and two opposite free ends extended out of the mounting members through respective through holes.

4 Claims, 5 Drawing Sheets

ELECTRICAL CONNECTORS

BACKGROUND OF THE INVENTION (a) Field of the Invention

The present invention relates to electrical connectors and relates more particularly to an improved structure of electrical connector which provides much more terminals without increasing the size.

(b) Description of the Prior Art

A variety of electrical connectors have been proposed, and have been widely utilized in various fields. An ordinary electrical connector generally has two rows of male or female terminals fastened in parallel. U.S. Pat. No. 4,781,625 discloses a transferring device for electrical connectors, which reduces the size of an electrical connector by providing terminals of different configurations as compared with conventional ones. There is also disclosed a structure of switching device for electrical connector under U.S. Pat. Ser. No. 07/490,707, which also reduces the size of an electrical connector. These structures of transferring devices commonly comprise two rows of terminals, each of them has two connecting heads arranged at two opposite sides in a staggered and parallel manner.

SUMMARY OF THE INVENTION

It is one object of the present invention to provide an electrical connector which provides much more terminals without increasing the size. It is another object of the present invention to provide an electrical connector which is easy to manufacture and assemble. It is still another object of the present invention to provide an electrical connector which is durable in use.

According to the present invention, two opposite lateral rows and an intermediate row of terminals are fastened to two face matched mounting plates held by an outer shell. Each terminal has a central portion formed into a flat locating plate for positioning, and two elongated contact rods respectively extended from the central portion in reverse directions. The two elongated contact rods of either intermediate terminal are respectively inserted through aligned through holes on the mounting members. The two elongated contact rods of either lateral terminal are respectively inserted through holes on the mounting members at two opposite sides. Chamfered edges are made on the flat locating plate of each terminal for easy mounting.

DETAILED DESCRIPTION OF THE PREFERRED EMBODIMENT

Figure 1:
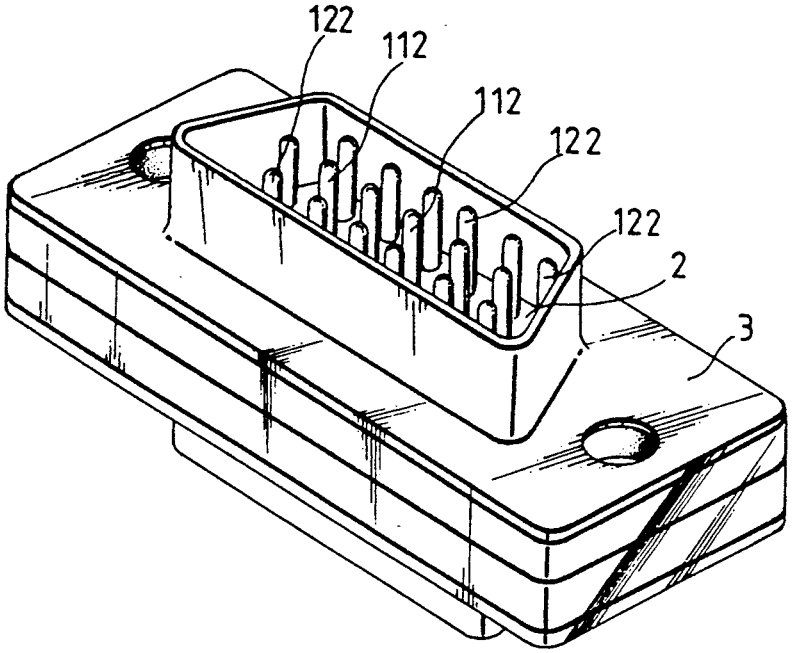
FIG. 1 is an elevational view of an electrical connector as constructed in accordance with the present invention.
Figure 2:
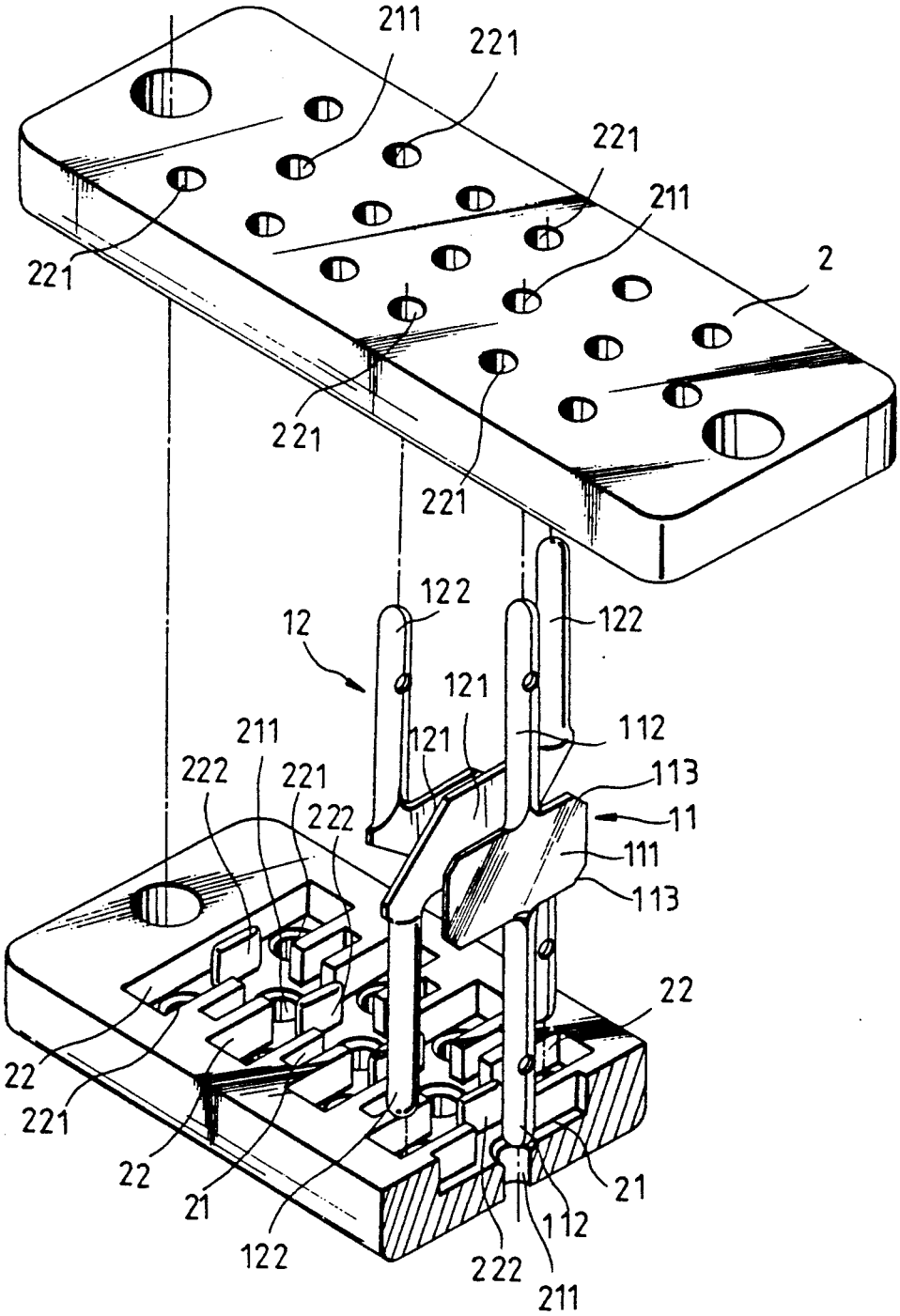
FIG. 2 is a perspective exploded view of the electrical connector of FIG. 1.

Referring to FIGS. 1 and 2, an electrical connector as constructed in accordance with the present invention is generally comprised of a row of intermediate terminals 11, two symmetrical rows of lateral terminals 12, two plastic mounting members 2, and an outer shell 3. The structure of the outer shell 3 is similar to the prior art and not within the scope of the present invention.

Figure 3:
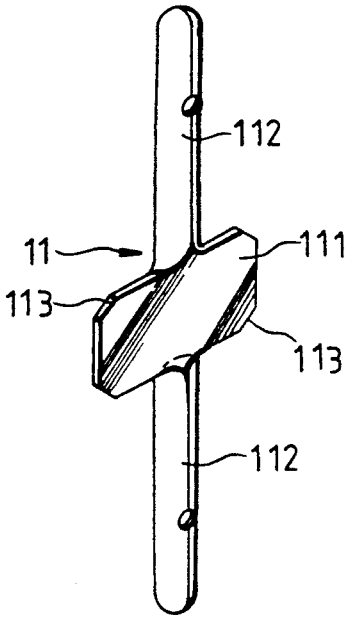
FIG. 3 is an elevational view of an intermediate male terminal according to the present invention.
Figure 4:
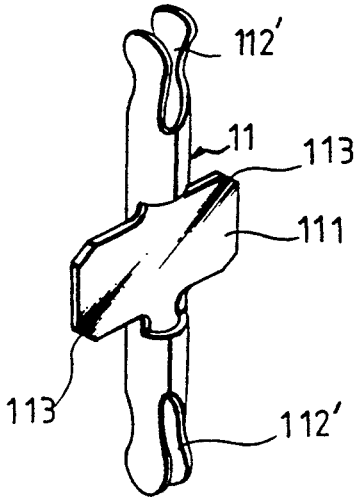
FIG. 4 is an elevational view of an intermediate (female) terminal according to the present invention.
Figure 5:
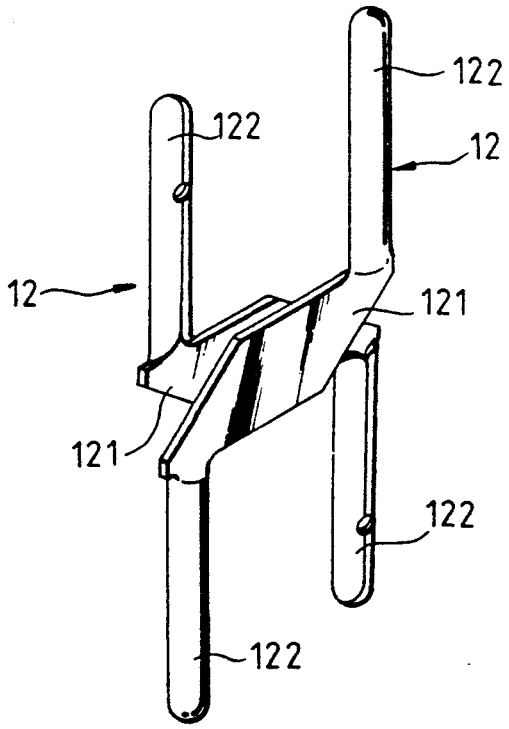
FIG. 5 is an elevational view of a pair of lateral (male) terminals according to the present invention.

Referring to FIGS. 3, 4 and 5, the intermediate terminal 11 is made in the shape of a crossed pattern, comprising two elongated male or female contact rods 112 or 112' longitudinally aligned and spaced by a central portion, which forms into a flat, rectangular locating plate 111; the lateral terminal 12 comprises two elongated male or female contact rods 122 or 122' respectively extended from two diagonal corners of a central portion 121 thereof in reverse directions, which central portion 121 forms into a flat locating plate in the shape of a parallelogram.

Referring to FIG. 2 again, the two plastic mounting members 2 are symmetrical and face-matched, having each a plurality of small transverse recesses 21 and big transverse recesses 22 alternatively disposed on a respective large inside face, a row of intermediate through holes 211 respectively pierced through the small transverse recesses 21, two opposite rows of lateral through holes 221 respectively pierced through the big transverse recesses 22, and a series of partition boards 222 respectively disposed in the big transverse recesses 22. The small transverse recess 21 receives the locating plate 111 of a respective intermediate terminal 11. The big transverse recess 22 receive the locating plate 121 of either pair of opposite lateral terminals 12. Because of the arrangement of the partition boards 222, the locating plate 121 of one lateral terminal 12 in each big transverse recess 22 is separated from the locating plate 121 of the other lateral terminal 12 in the same transverse recess 22.

Figure 6:
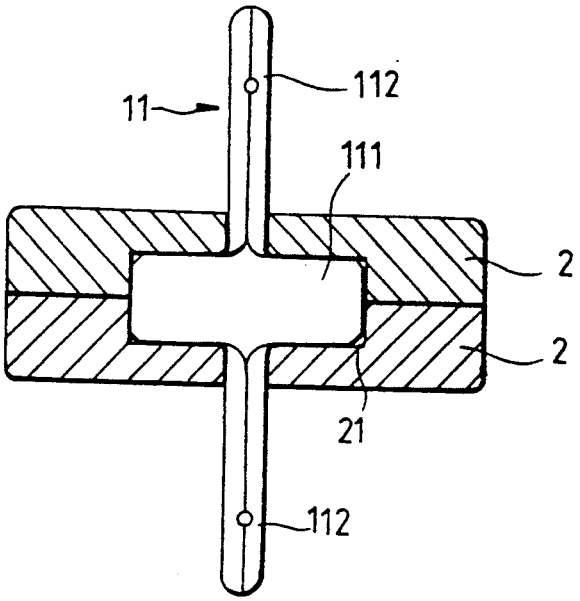
FIG. 6 is a sectional assembly view showing a male intermediate terminal retained by the two mounting members.
Figure 7:
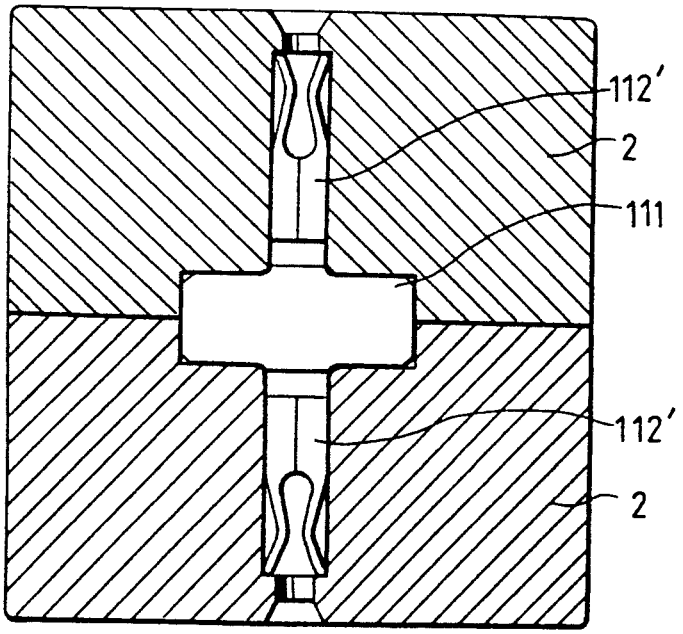
FIG. 7 is a sectional assembly view is a plain view showing a female intermediate terminal retained by the two mounting members.
Figure 8:
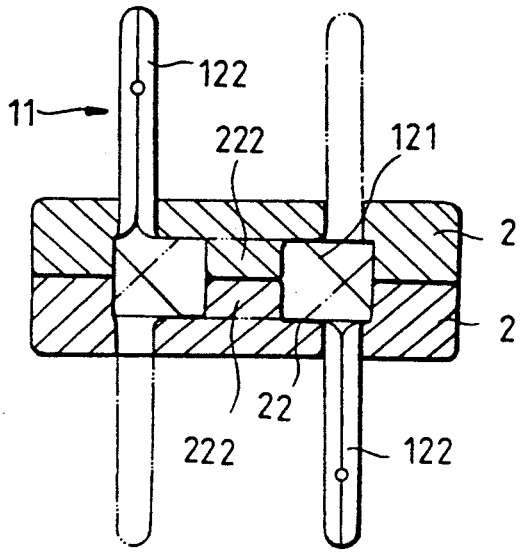
FIG. 8 is a sectional assembly view showing a pair of male lateral terminals retained by the two mounting members.

Referring to FIGS. 6, 7 and 8, the flat, rectangular locating plate 111 of each intermediate terminal 11 is respectively inserted into either small transverse recess 21 with the two opposite contact rods 112 or 112' of each intermediate terminal 11 respectively inserted through their corresponding intermediate through holes 211 on the plastic mounting members 2, the flat locating plate 121 of each of either row of lateral terminals 12 is respectively inserted into either big transverse recess 22 at either side by the respective partition board 222 with the two opposite contact rods 122 or 122' of each lateral terminal 11 respectively inserted through their corresponding lateral through holes 221 on the plastic mounting members 2 for permitting either pair of lateral terminal 12 in either big transverse recesses 22 to be arranged into a substantially "H" shaped configuration when views from either side (see FIG. 5). As the locating plate 111 or 121 has its four corners respectively chamfered 113, it can be conveniently inserted into either transverse recess 21 or 22 on either plastic mounting member 2.

Referring to FIG. 1 again, an electrical connector according to the aforesaid arrangement can be fastened with much more terminals for electric contacts as compared with the prior art electrical connectors of the same size.

Figure 9:
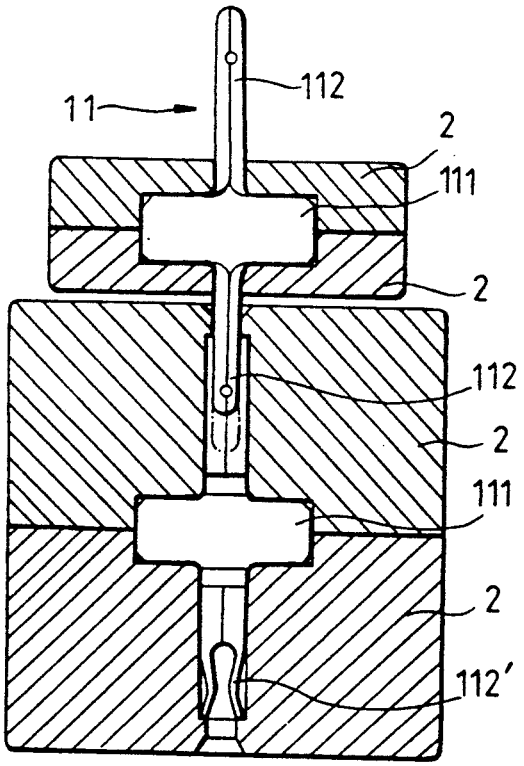
FIG. 9 is a sectional view showing a male electrical connector connected to a female electric connector according to the present invention.

Referring to FIG. 9, therein illustrated is a male electrical connector connected to a female electric connector according to the present invention. As the locating plate 111 of each terminal in is firmly retained between the two plastic mounting members 2 of the respective electrical connector, the terminals of the male electrical connector can be firmly connected to the terminals of the female electrical connector.

What is claimed is:

1. An electrical connector comprising two face-matched plastic mounting members covered with an outer shell to hold a plurality of contact terminals, wherein:

said mounting members have each a plurality of small transverse recesses and big transverse recesses alternatively disposed on a respective large inside face, a row of intermediate through holes respectively pierced through the small transverse recesses, and a row of first lateral through holes and a row of second lateral through holes respectively pierced through the big transverse recesses at two opposite sides relative to the row of intermediate through holes;

said terminals include of a plurality of intermediate terminals and pairs of lateral terminals, each intermediate terminal comprising a flat, rectangular locating plate respectively fitted into either small transverse recess on either mounting member and two elongated contact rods respectively extended from the flat, rectangular locating plate in reverse directions and respectively inserted in either intermediate through hole on either mounting member, each lateral terminal comprising a central portion formed of a flat, parallelogramic locating plate respectively fitted into either chamber of either big transverse recess and two elongated contact rods respectively extended from two diagonal corners of the flat, parallelogramic locating plate in reversed directions and respectively inserted in either lateral through hole of the first row of lateral through holes on one mounting member and either lateral through hole of the second row of lateral through holes on the other mounting member, the flat, parallelogramic locating plates of the same pair of lateral terminals being respectively inserted into the same big transverse recess.

2. The electrical connector of claim 1 wherein each terminal is a male contact terminal.

3. The electrical connector of claim 1 wherein each terminal is a female contact terminal.

4. The electrical connector of claim 1 wherein a series of partition boards are respectively disposed in said big transverse recesses to separate the flat, parallelogramic locating plate of either lateral terminal from the flat, parallelogramic locating plate of the lateral terminal of the same pair.

* * * * *